United States Patent [19]

Fish et al.

[11] Patent Number: 5,005,884

[45] Date of Patent: Apr. 9, 1991

[54] CYLINDER LOCK MODIFIED FOR USE WITH A CARD READER UNLOCKING MECHANISM

[75] Inventors: Aaron M. Fish, St. Luc; Alexander Branover, St. Laurent; Jean-Paul Dausseing, Laval; Masoud Miresmaili, LaSalle, all of Canada

[73] Assignee: Ilco Unican Inc., Montreal, Canada

[21] Appl. No.: 474,395

[22] Filed: Feb. 6, 1990

[30] Foreign Application Priority Data

Feb. 7, 1989 [CA] Canada ..... 590355

[51] Int. Cl.[5] ..... F05B 41/00

[52] U.S. Cl. ..... 292/336.3; 70/432; 292/1; 292/DIG. 37

[58] Field of Search ..... 70/432, 434; 292/336.3, 292/169, 1, 144, DIG. 37

[56] References Cited

U.S. PATENT DOCUMENTS

| | | | |
|---|---|---|---|
| 2,193,349 | 3/1940 | Schlage | 70/432 |
| 3,125,876 | 3/1964 | Kuchler | 70/432 |
| 3,600,916 | 8/1971 | Ruppert | 70/432 |
| 4,559,796 | 12/1985 | De Forrest, Sr. | 70/434 |
| 4,683,741 | 8/1987 | Fields | 70/432 |

*Primary Examiner*—Eric K. Nicholson

*Attorney, Agent, or Firm*—Fleit, Jacobson, Cohn, Price, Holman & Stern

[57] ABSTRACT

The pushing in of the push-button of the cylinder lock is detected by detecting the associated motion of the locking rod. An electronic signal is provided upon the detection of such motion. In specific embodiments, the detector consists of a switch mounted on either the locking rod or locking rod cylinder, and an associated cam mounted on either the locking rod cylinder or the locking rod.

5 Claims, 3 Drawing Sheets

CYLINDER LOCK MODIFIED FOR USE WITH A CARD READER UNLOCKING MECHANISM

BACKGROUND OF INVENTION

1. Field of the Invention

The invention relates to a cylinder lock modified for use with a card reader unlock means and/or associated electronics. More specifically, the invention relates to such a modified cylinder lock which will provide an electronic signal under predetermined conditions.

2. Description of Prior Art

In, for example, hotel room locking arrangements, to provide a privacy feature, a deadbolt arrangement is activated from inside the room. Thus, the door cannot be opened from the outside of the room.

With cylinder locks, it is similarly possible to provide lock-out privacy from the inside of the room using a push-button and locking rod arrangement. The push-button, as well known, is mounted centrally of the inside door knob. The push-button is connected to a locking rod, and when the push-button is pushed in, the locking rod engages the outside door knob to prevent it from turning. Thus, once again, the door can be opened only from the inside, but without a deadbolt arrangement.

With the advent of electronic locks, including card reading means, it would be useful to modify the cylinder lock to provide an electronic signal under predetermined conditions.

SUMMARY OF INVENTION

It is therefore an object of the invention to modify a cylinder lock to provide an electronic signal under predetermined conditions.

It is a more specific object of the invention to provide such a modified cylinder lock which will provide an electronic signal when the push-button thereof is pushed in.

In accordance with the invention, the pushing in of the push-button is detected by detecting the associated motion of the locking rod, and the electronic signal is provided upon the detection of such motion.

BRIEF DESCRIPTION OF DRAWINGS

The invention will be better understood by an examination of the following description, together with the accompanying drawings, in which:

FIG. 2A illustrates the arrangement in the rest position while FIG. 2B illustrates the arrangement in the actuated position;

FIGS. 3A and 3B illustrate an alternate arrangement for detecting the motion of the locking rod and FIG. 3A illustrates the arrangement in the rest position while FIG. 3B illustrates the arrangement in the actuated position;

DESCRIPTION OF PREFERRED EMBODIMENTS

Figure 1:
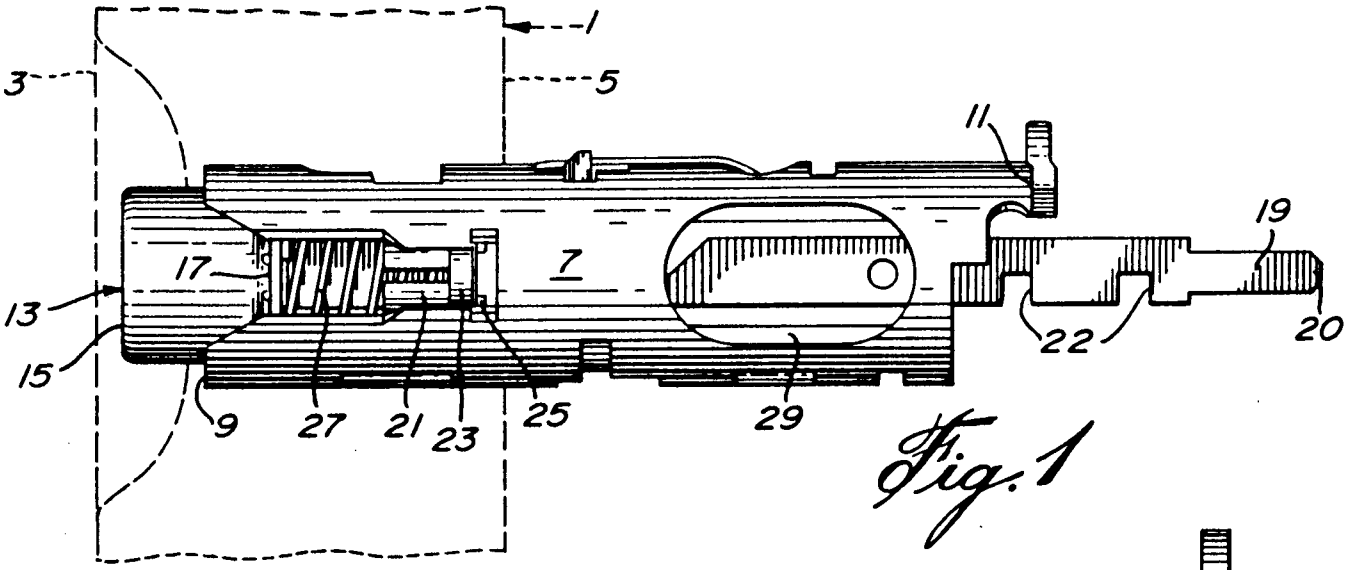
FIG. 1 illustrates schematically the inside door mechanism of a cylinder lock.

Referring to FIG. 1, 1 is an inside door circular knob which has a free end 3 and a connected end 5 and extends longitudinally from the free end to the connected end thereof. A locking rod cylinder 7 partially enclosed within the knob extends in the longitudinal direction of the knob. The locking rod cylinder 7 is coaxial with the knob and has first end 9, which is adjacent to the free end 3 of the knob. The cylinder extends longitudinally from the first end 9 to a second end 11 thereof.

A push-button 13 is coaxially mounted in the knob 1 and cylinder 7 and extends longitudinally from a free end 15 to a connected end 17 thereof through the free end 3 of the knob and into the cylinder from the first end 9 thereof. Locking rod 19 extends longitudinally from the free end 15 of the push-button 13 through the cylinder 7. Turn stop cylinder 21 surrounds the locking rod, and the rod extends through the turn stop cylinder end opening 23. Retaining clip 25, mounted on the locking rod, prevents the turn stop cylinder from moving rightwardly in FIG. 1. Disposed between the turn stop cylinder end wall 23 and the connected end 17 of the push-button 13 is a spring 27. Opening 29 is provided in the cylinder for reasons to be discussed below.

With the arrangement as thus far described, and as known in the art, in order to provide a privacy lock-out, the push-button 13 is pushed inwardly, i.e., in the direction from the free end 3 to the connected end 5 of the knob 1. This will cause the locking rod 19 to move rightwardly, and the free end 20 of the locking rod will then engage the outside knob to prevent it from turning. Openings 22 on the locking rod 19 will engage a mechanism to retain the locking rod in its inward condition against the force of the spring 27 until the knob 1 is rotated to eliminate the lock-out mechanism.

In accordance with the invention, the inward movement of the locking rod is detected to thereby actuate a means for providing an electronic signal. One arrangement for such detection is illustrated in FIGS. 2A and 2B.

Figure 2A:
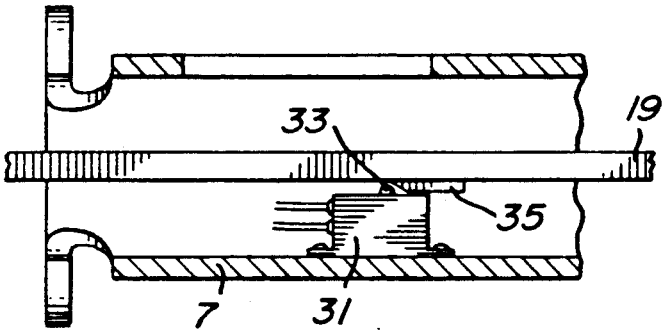
FIGS. 2A and 2B illustrate an arrangement for detecting the movement of the locking rod.
Figure 2B:
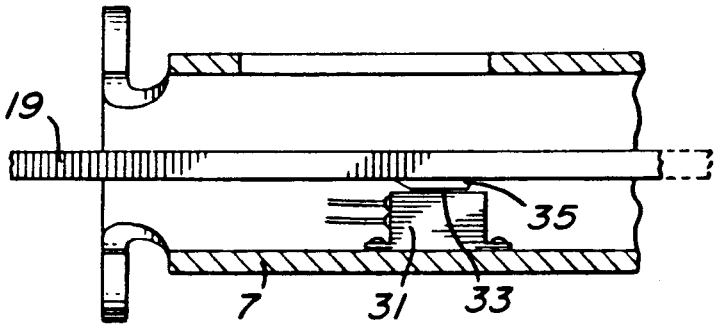

Turning now to FIGS. 2A and 2B, a two-state pressure sensitive switch 31, having a plunger 33, is mounted on the locking rod cylinder 7. A cam 35 is mounted on the locking rod 19. As seen in FIG. 2A, when the arrangement is in its rest position, i.e., push-button 13 is not pushed in, then the cam 35 does not engage the plunger 33 of the switch 31 so that the switch 31 is in one of its states. When the locking rod 19 is in its actuated position, i.e., push-button 13 has been pushed in, cam 35 engages the plunger 33 to push it inwardly so that the switch 31 is in the other one of its states. Thus, switch 31 could be open in the rest position and closed in the actuated position.

Turning now to FIG. 3, in FIG. 3 a mounting means mounted on locking rod 19 mounts a spring leaf switch 39 having a spring leaf 41. In this arrangement, the opening 29 acts as a cam.

Figure 3A:
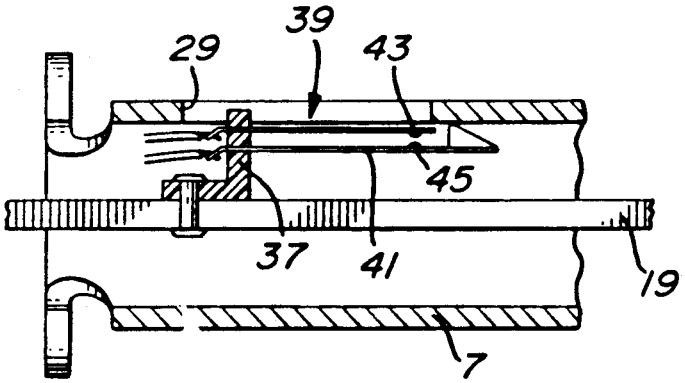
Figure 3B:
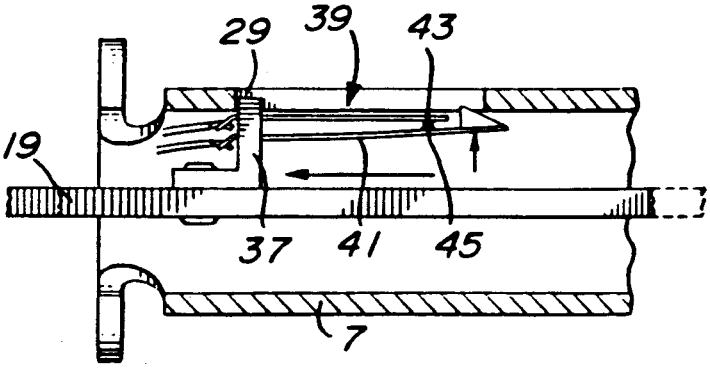

As seen in FIG. 3A, in the rest position (with the push-button 13 not pushed inwardly) the switch is open, i.e., contacts 43 and 45 are separated. In the actuated position, illustrated in FIG. 3B, with the push-button pushed inwardly, the switch is in its closed position, i.e., contacts 43 and 45 are touching. Accordingly, once again, the spring leaf switch is changed from a first condition in its rest position to a second condition in its actuated position.

Figure 4:
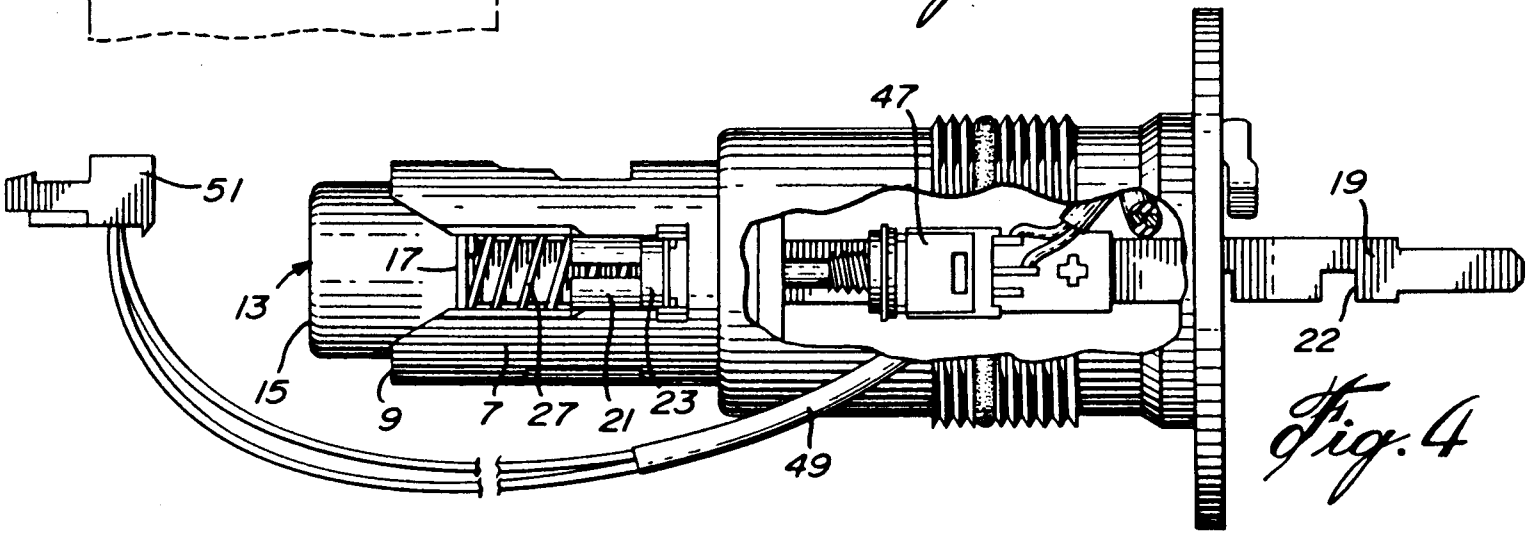
FIG. 4 illustrates the electrical connection from the detector to a means for providing an electronic signal.

Turning now to FIG. 4, the detector is illustrated at 47 and is electrically connected, by leads 49 to a means 51 for providing the electronic signal. The means 51 could be a battery which is connected to a specific point in an electronic circuit when the switch is either open or closed. Thus, the battery could be connected to a transistor to turn the transistor ON when movement movement of the locking rod is detected.

In a practical embodiment, 51 would constitute an electrical connector which would be connected to appropriate terminals of electronic circuitry.

Although the detector has been illustrated in FIGS. 2 and 3 as a mechanical switch, it will be apparent to one skilled in the art that a light sensitive switch, or a magnetic switch, could equally well be used. It is only necessary that the detector have two states, and that the movement of the locking rod be adaptable to change the detector from its first state to its second state or vice-versa.

Figure 5:
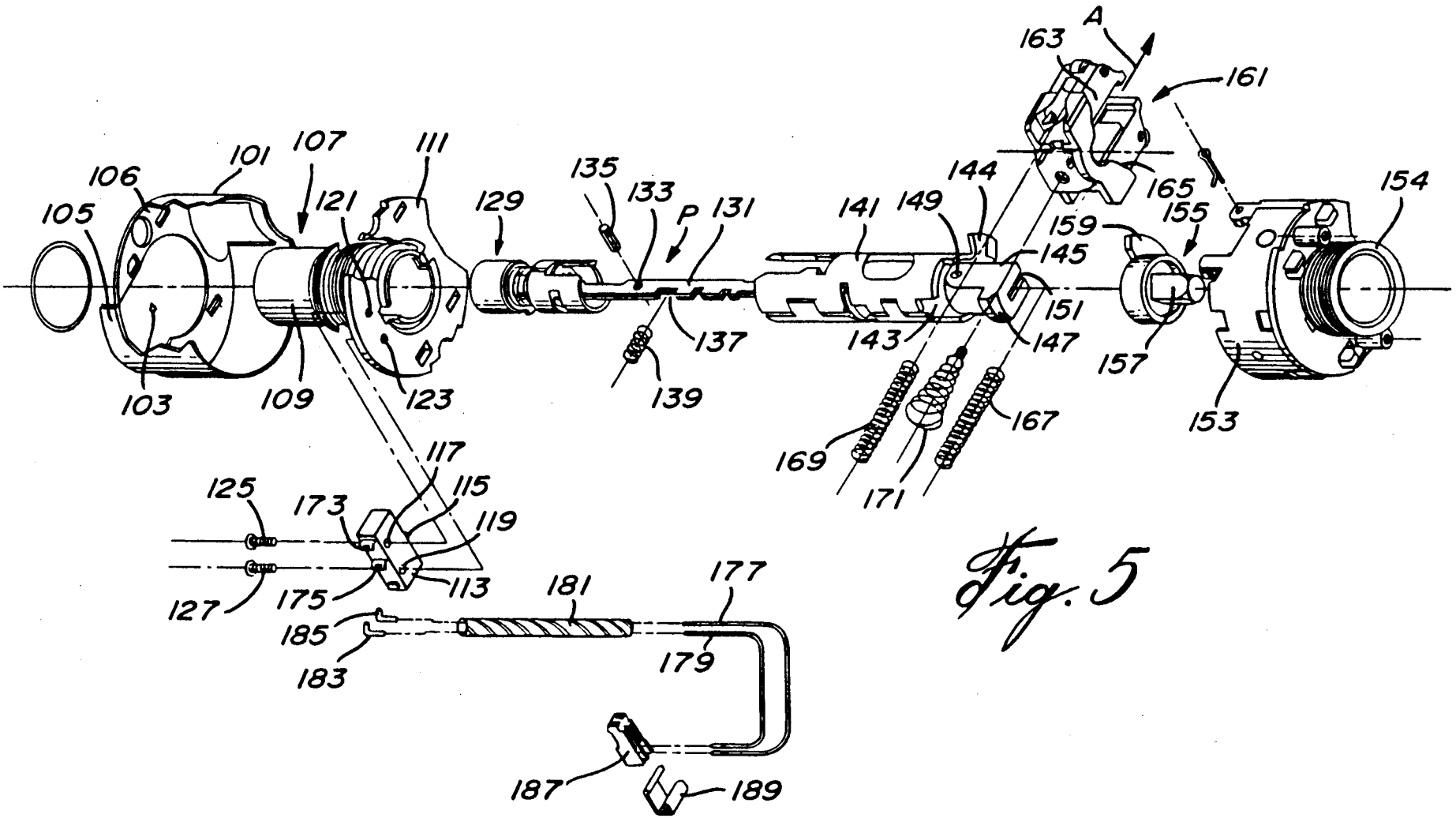
FIG. 5 is an exploded view of a cylindrical drive unit assembly.

Referring now to FIG. 5, the cylindrical drive unit assembly comprises, as in prior art such assemblies, a retractor assembly housing 101. The retractor assembly housing 101 is modified, in accordance with the invention, to include an opening 103 and an outer flange 105 the purposes of which will be discussed below. The retractor assembly housing 101 also includes a front wall 106.

The cylindrical drive unit assembly also includes a retractor assembly retainer cap assembly 107 having a cylindrical extension 109 and a plate 111. When the cylindrical drive unit assembly is assembled, the plate 11 abuts the inner surface of the front wall 106.

A switch 113 is mounted on the front surface of the plate 111 as described below. The switch 113 includes a plunger 115 and openings 117 and 119. When assembled, the openings 117 and 119 are aligned with openings 121 and 123 of plate 111, and screws 125 and 127 extend, respectively, through openings 117, 121 and 119, 123. The screws will fix switch 113 to plate 111.

When plate 111 abuts the inner surface of front wall 106, switch 113 will extend outside of retractor assembly housing 101 through opening 103 and adjacent to flange 105.

Push-button 129, which will extend through retractor assembly retainer cap assembly 107 and beyond the cylindrical extension 109 thereof (as shown, for example, in FIG. 4 hereof) is once again connected with locking rod 131. Locking rod 131 includes an opening 133 through which pin 135 will extend as explained below. It also includes an indent 137, and spring 139 is disposed in the indent as will also be discussed below.

Locking rod cylinder 141 is modified to include opening 143 for purposes to be discussed below. The locking rod cylinder 141 includes ears 144 as is well known in the art.

Camming member 145 includes a camming surface 147, an opening 149, which extends the full width of the camming member, and a slot 151. When assembled, the camming member will be located at the position indicated by the arrow P such that opening 149 is aligned with opening 133. Pin 135 extends through openings 149 and 133 to retain the camming member at the position P on the locking rod. The legs of the slot 151 overlie the locking rod, and spring 139 extends into the slot 151 to thereby bias the camming member away from the locking rod to thereby provide a positive force for engaging the plunger 115 of the switch 113 as discussed below.

As will be apparent, the indoor door knob will be attached to overlie the push-button as illustrated in FIG. 1 hereof. The outdoor door knob will be connected to retractor assembly retainer assembly 153 which includes a cylindrical extension 154. Drive hub shaft assembly 155 extends through cylindrical extension 154 and beyond the cylindrical extension such that shaft 157 of drive hub shaft assembly 155 will engage the outdoor door knob. Such an arrangement is well known in the art. The drive hub shaft assembly 155 includes an ear 159.

Retractor assembly 161 includes ridges 163 and 165 on one side thereof and similar ridges (not seen) on the other side thereof. Springs 167, 169 and 171 spring-bias the retractor assembly 161 when it is mounted in the retractor assembly retainer assembly as known in the art. When assembled, retractor assembly retainer assembly 153 is housed in retractor assembly housing 101.

Switch 113 includes contacts 173 and 175 which are connected, respectively, to wires 177 and 179. Wires 177 and 179 extend through, for example, a spiral wrap 181 and thence, respectively, through each ring insulating tubings 185 and 183. The flange 105 serves to protect the contacts 173 and 175.

Wires 177 and 179 are also connected to female connector 187 which is mounted in a cover 189.

In operation, and with the cylindrical drive unit assembly assembled, the camming member 145 extends out of the locking rod cylinder 141 through opening 143 and is disposed to the left of switch 113 which is in a first state. When the push-button 129 is pushed inwardly (to the left), camming surface 147 engages plunger 115 of switch 113 to thereby change the state of the switch. The change in state is transmitted by wires 177 and 179 to connector 187 and then on to whichever part of the circuit such status change needs to be transmitted. Because of the width of the camming surface 147, the camming surface will maintain the plunger in an actuated condition even when the indoor door knob is rotated.

Although several embodiments have been described, this was for the purpose of illustrating, but not limiting, the invention. Various modifications, which will come readily to the mind of one skilled in the art, are within the scope of the invention as defined in the appended claims.

We claim:

1. A cylinder lock comprising:

a circular door knob having a free end and a connected end and extending longitudinally from said free end to said connected end;

a locking rod cylinder partially enclosed within said door knob and extending longitudinally of said door knob and coaxially with said door knob, and having a first end adjacent said free end of said door knob;

a push-button, having a free end and an attached end, and mounted coaxial with said door knob and extending, from the free end thereof, from the outside of said door knob through said free end of said door knob and into said cylinder through the first end thereof;

a locking rod, extending longitudinally from said attached end of said push-button and through said cylinder;

whereby, when said push-button is pushed inwardly, in the direction from the free end to the connected end of said knob, said locking rod moves in the same direction;

means for detecting the movement of said locking rod; and whereby, means for providing an electronic signal are activated by said means for detecting on detecting the movement of the locking rod, to provide said electronic signal;

and further including a cylindrical detector assembly housing having a front end and an open rear end;

a wall at said front end having an opening therein;

a retractor assembly retainer cap assembly comprising a cylindrical member having a front end and a rear end;

a plate member mounted transversely to said cylindrical member at the rear end thereof;

the front surface of said plate member abutting the rear surface of said wall;

said means for detecting comprising a twostate switch;

said switch being mounted on the front surface of said plate member;

said opening of said wall receiving said cylindrical member and said switch such that said cylindrical member and said switch extend in front of said front wall outside of said housing.

2. A cylinder lock as defined in claim 1 and including a camming member mounted on said locking rod;

an opening in said locking rod cylinder through which said cam extends.

3. A cylinder lock as defined in claim 2 wherein, when said push-button is not pushed in, said camming member does not engage said switch; and when said push-button is pushed in, said camming member engages said switch;

whereby, when said push-button is pushed in, the state of said switch is changed.

4. A cylinder lock as defined in claim 3 and including a flange on said retractor assembly housing extending in front of the front wall thereof to shield said switch.

5. A cylinder lock as defined in claim 4 wherein said means for providing is actuated by said switch when said switch is in one of its states.

* * * * *